US005287667A

United States Patent [19]

Singhal

[11] Patent Number: 5,287,667

[45] Date of Patent: Feb. 22, 1994

[54] WATER PROOF TILE FOR TUB AND TILE CORNERS

[76] Inventor: Tara C. Singhal, P.O. Box 5075, Torrance, Calif. 90510

[21] Appl. No.: 992,541

[22] Filed: Dec. 17, 1992

Related U.S. Application Data

[63] Continuation-in-part of Ser. No. 798,530, Nov. 27, 1991, abandoned.

[51] Int. Cl.[5] ..... E04F 13/08

[52] U.S. Cl. ..... 52/392; 52/35; 52/716.2; 52/287.1

[58] Field of Search ..... 52/35, 392, 390, 34, 52/716.2, 288, 747

[56] References Cited

U.S. PATENT DOCUMENTS

| | | | |
|---|---|---|---|
| 2,541,768 | 2/1951 | Keller | 52/34 |
| 2,677,268 | 5/1954 | Hobbs | 52/35 |
| 4,601,149 | 7/1986 | Dokan | 52/35 |

*Primary Examiner*—Michael Safavi

[57] ABSTRACT

A tile for waterproofing the juncture of a tiled surface and a non tiled surface such as a tub and tile juncture by use of a water proof tile. The waterproof tile consists of a glazed tile surface having a curvature which directs the water away from the juncture, a non glazed surface which is cemented to the tiled wall and a bottom side which holds sealant for sealing against the non tiled surface.

7 Claims, 1 Drawing Sheet

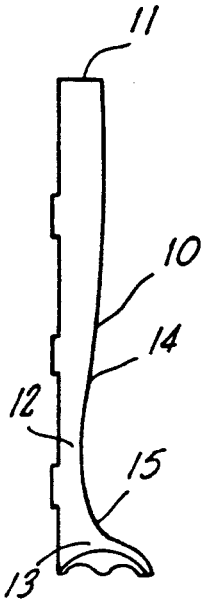
FIG. 1b.
FIG. 1a.
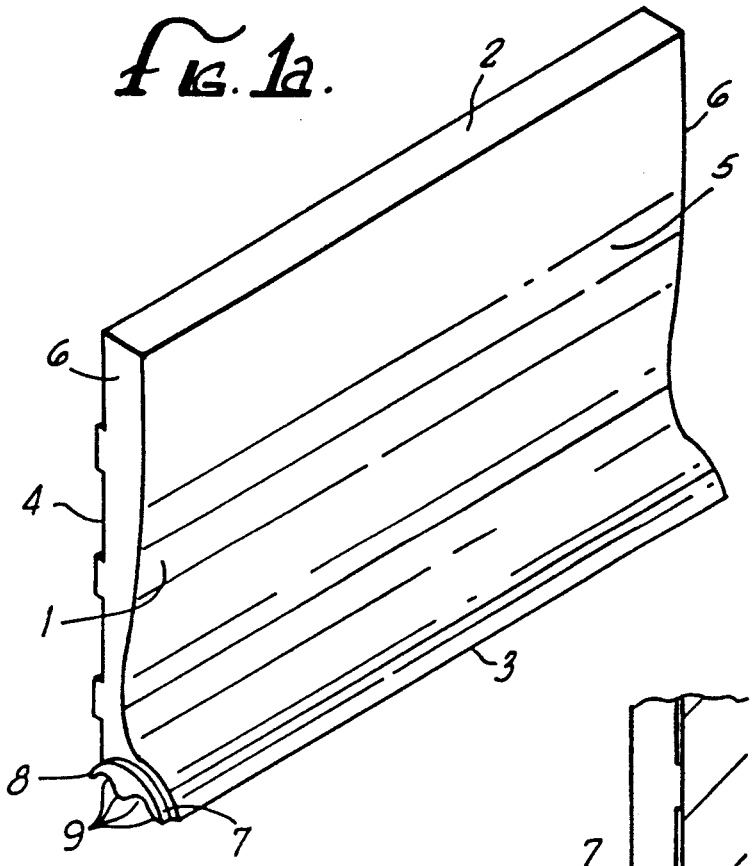
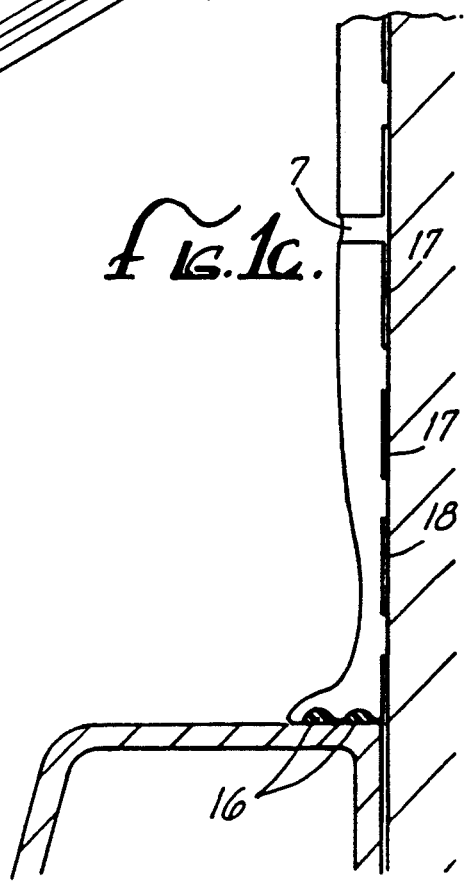
FIG. 1c.
FIG. 2.
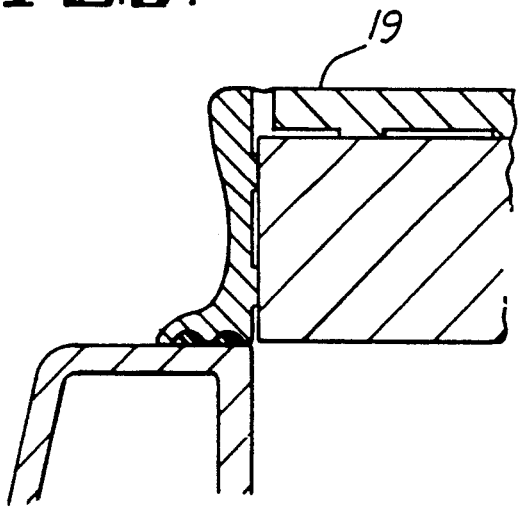

WATER PROOF TILE FOR TUB AND TILE CORNERS

CROSS REFERENCE

Continuation-in-part of Ser. No. 07/798,530, filed Nov. 27, 1991, SINGHAL T., now abandoned.

BACKGROUND OF THE INVENTION

1. Field of Invention

A tiled surface when it is installed at a nontiled surface juncture such as a tiled wall abutting a bath tub, the space between the tile edge and the tub surface is filled with the tile grout material. In addition the tub tile joint is further water sealed by application of caulking material.

This means of waterproofing a tiled and a non-tiled surface juncture is not permanent and does give trouble after a few years. The caulking material develops separation where it joins the tile, as it ages and gets mouldy and dirty from the water falling on it. The grout between the tub and tile develops hairline cracks because when the tub is put weight into of water and people, the tub surface separates from the grout. As a result after some time water starts leaking to the side of the tub, and then inside the walls. This water leakage causes damage to the underlying wood frame structure and to the plaster covering the wood frame structure.

This invention concerns a waterproof tile installed as part of the tiled surface for tub tile corners for providing a permanent solution to tub and tile joint leakage problems.

2. Description of Related Art

Identified by the examiner in Ser. No. 07/798,530.

SUMMARY OF THE INVENTION

A waterproof tile, installed at the tub and tile corner, has a foot shaped edge. The surface on the bottom side of the foot shaped edge of the tile is corrugated, with alternating ridges and valleys. This surface is sealed with a rubber like sealant against the horizontal tub edge keeping the water away from the tub tile corner. The finished side of the tile has a curvature made by varying the width of the tile. The curvature helps in directing the water away from the tub and tile corner.

BRIEF DESCRIPTION OF THE DRAWINGS

FIG. 1*a*: A perspective view of the tile showing all its features.

FIG. 1*b*: Side view of the tile showing the curvature on the front side of the tile.

FIG. 1*c*: Side view of the tile showing method of installation of the tile with the tile's back side cemented to the wall and its bottom side sealed to the tub surface.

FIG. 2: Application of the tile to horizontal tile surface and sink surface joint.

DESCRIPTION OF THE PREFERRED EMBODIMENT

A tile when it abuts a bath tub, the space between the tile and the tub surface is filled with the tile grout material. In addition the joint is further water sealed by the application of tile caulking material between the tile and tub corner. This means of water proofing the tub and tile joints is not permanent and does give trouble after a few years because the caulking material develops separation where it joins the tile as it ages and gets mouldy and dirty from the water falling on it.

The grout between the tile and tub develops hairline cracks because when the weight of water and people is put into the tub or sink, the tub surface separates from the grout. As a result after some time water starts leaking to the sides of the tub, to the inside of the walls, which causes damage to underlying wood frame structure and to the plaster covering the wood frame structure.

This invention concerns a waterproof tile for tub tile corners which provides a permanent solution to tub and tile leakage problems. This invention solves the basic and long existing problem of tub/tile joints but does so in a manner that is different as well as superior in many respects to the prior art.

Refer to FIGS. 1*a* showing a tile useful for sealing the junction of a tiled surface and a non-tiled surface, such as a tub or counter top (1). The tile has a body having a top, bottom, back, front, left and right sides.

The top side is rectangular and has a width of W and a thickness of T (2). The bottom side is rectangular and has a width of W and a thickness which is greater than T (3). The bottom side is disposed parallel to the top side and the distance between the top and bottom side is H. The back side is rectangular and has a width of W and a height of H and is perpendicular to the top and bottom sides (4). The front side has the width of W (5) and the left and right sides each has the height of H (6). The left and right sides are disposed perpendicular to the top, bottom, back and front sides. The left and right sides are parallel and the distance between the left and right sides is W.

The thickness of the grout or the space between this tile and the other tiles on the tiled surface is G.

The bottom side of the tile is covered with a corrugated surface (8). The corrugated surface at the bottom side comprises a plurality of ridges and valleys (9). These ridges and valleys are disposed parallel to the width of the bottom side.

The ridges and valleys extend past the tile width on one side of the tile as at 7 about nearly the width of the grouting G that is used between the sides of the tiles. Alternatively, the extension could also be one-half G on both the left side and the right side. This extension provides for continuity of the rubber type sealant seal to the space between two of these tiles on the tiled wall where the grout is used.

The tile is made of a hard substance the tiles are usually made of such as ceramic or china. The front side of the tile is finished/glazed. The backside is unfinished-/unglazed and is used for cementing the tile to the wall surface.

See FIG. 1*b*. The front side o the tile is curved by varying the thickness of the tile (10). The thickness of the tile is T at the top side (11), the thickness of the tile is less than T between the top and bottom sides (12) and the thickness of the tile is greater than T at the bottom side (13). The thickness of the tile decreases from the top side to approximately one-half T between the top and the bottom side and subsequently increases to approximately two T at the bottom side. The thickness of the tile decreases gradually from the top side to approximately one-half T between the top and the bottom side (14) and, subsequently the thickness increases rapidly to approximately two T at the bottom side (15).

A method of installing the tiles is disclosed as follows. See FIG. 1*c*. A method for sealing the junction between a tiled wall, the tile having a thickness of T, and a non-tiled surface, such as a tub or counter top, the method requires the step of simultaneously cementing the tile to the wall while applying the sealant between the bottom side of the tile and the non-tiled surface.

First a rubber like sealant bead, approximately greater than T wide, approximately T thick and approximately (W+G) in length is placed on the edge of the tub near the tub tile juncture. (16) Then cement is applied to the backside of the tile. (17) The bottom of the tile is then placed on the rubber like sealant bead so that it is riding the rubber like sealant bead and its ridges and valleys press into the sealant with the bottom side of the tile nearly touching the edge of the tub. Simultaneously the backside of the tile is pressed to the tile wall cementing it to the wall. (18)

When water is coming against the tiled wall surface it flows away from the tub tile joint. The rubber like sealant and the corrugated edged keeps water and moisture away from the tub tile joint.

This tile is also suitable for use with those tiles that are specifically designed for inside and outside corners and turns in the horizontal or vertical or other angle tile surfaces where these tile surfaces abut the tub and sink type enclosures. FIG. 2. shows the application of this tile where the tile surface is horizontal (19).

Therefore I claim:

1. A tile useful for sealing the junction of a tiled surface of thickness T and a non-tiled surface, such as a tub or counter top, the tile comprising;

(a) a body having a top, bottom, back, front, left and right sides;

(b) the top side being rectangular and having a width of W and a thickness of T;

(c) the bottom side being rectangular and having a width of W and a thickness which is greater than T, wherein (1) the bottom side has a corrugated surface, (2) the bottom side is disposed parallel to the top side and (3) the distance between the top and bottom side is H;

(d) the back side being rectangular and having a width of W and a height of H and being perpendicular to the top and bottom sides;

(e) the front side having the width of W; and (f) the left and right sides each having the height of H, wherein (1) the left and right sides are disposed perpendicular to the top, bottom, back and front sides, (2) the left and right sides are parallel and (3) the distance between the left and right sides is W;

(g) the front side is curved by varying the thickness of the tile, wherein;

(1) the thickness of the tile is T at the top side, (2) the thickness of the tile is less than T between the top and bottom sides and (3) the thickness of the tile is greater than T at the bottom side;

(h) the front side of the tile is finished/glazed;

(i) thickness of grout/space between the tile and other tiles on the tiled surface is G.

2. The tile of claim 1, wherein the thickness of the tile decreases from the top side to approximately one-half T between the top and the bottom side and subsequently increases to approximately two T at the bottom side.

3. The tile of claim 1, wherein the thickness of the tile decreases gradually from the top side to approximately one-half T between the top and the bottom side and, subsequently the thickness increases rapidly to approximately two T at the bottom side.

4. The tile of claim 1 wherein the corrugated surface at the bottom side comprises a plurality of ridges and valleys.

5. The tile of claim 4, wherein the ridges and the valleys are parallel to the width of the bottom side.

6. The tile of claim 4, wherein the ridges and valleys extend the distance of G past the tile width W on one side of the tile.

7. The tile of claim 4, wherein the ridges and valleys extend the distance of one-half G past the tile width W on the left and right sides of the tile.

* * * * *